US010111568B2

(12) United States Patent
Machida et al.

(10) Patent No.: US 10,111,568 B2
(45) Date of Patent: Oct. 30, 2018

(54) ELECTRIC VACUUM CLEANING APPARATUS

(71) Applicant: TOSHIBA LIFESTYLE PRODUCTS & SERVICES CORPORATION, Kawasaki-shi (JP)

(72) Inventors: Yukio Machida, Owariasahi (JP); Masatoshi Tanaka, Seto (JP); Hiromitsu Ichikawa, Owariasahi (JP); Hiromitsu Murata, Kasugai (JP)

(73) Assignee: TOSHIBA LIFESTYLE PRODUCTS & SERVICES CORPORATION, Kawasaki-shi (JP)

( * ) Notice: Subject to any disclaimer, the term of this patent is extended or adjusted under 35 U.S.C. 154(b) by 78 days.

(21) Appl. No.: 15/504,945

(22) PCT Filed: Aug. 12, 2015

(86) PCT No.: PCT/JP2015/072860
§ 371 (c)(1),
(2) Date: Feb. 17, 2017

(87) PCT Pub. No.: WO2016/027745
PCT Pub. Date: Feb. 25, 2016

(65) Prior Publication Data

US 2017/0273532 A1 Sep. 28, 2017

(30) Foreign Application Priority Data

Aug. 20, 2014 (JP) ..... 2014-167653

(51) Int. Cl.
*A47L 9/10* (2006.01)
*A47L 9/28* (2006.01)
(Continued)

(52) U.S. Cl.
CPC ..... *A47L 9/2873* (2013.01); *A47L 5/22* (2013.01); *A47L 9/0405* (2013.01);
(Continued)

(58) Field of Classification Search
CPC ..... A47L 5/22; A47L 9/122; A47L 9/2873; A47L 9/149; A47L 9/0405; A47L 9/0477;
(Continued)

(56) References Cited

U.S. PATENT DOCUMENTS

2007/0157415 A1 7/2007 Lee et al.
2013/0305481 A1 11/2013 Jung et al.

FOREIGN PATENT DOCUMENTS

EP 2 564 749 A1 3/2013
JP 2007-181656 A 7/2007
(Continued)

OTHER PUBLICATIONS

International Search Report dated Nov. 17, 2015 in PCT/JP2015/072860 Filed Aug. 12, 2015.

*Primary Examiner* — David Redding
(74) *Attorney, Agent, or Firm* — Oblon, McClelland, Maier & Neustadt, L.L.P.

(57) ABSTRACT

An electric vacuum cleaning apparatus including an autonomous robotic vacuum cleaner that autonomously moves between surfaces to be cleaned and collects dust and a station fluidly connectable to the autonomous robotic vacuum cleaner. The autonomous robotic vacuum cleaner includes: a container body accumulating collected dust, the container body including: a bottom wall including a disposal port; and a disposal lid opening and closing the disposal port. The station unit includes: a dust transfer pipe connected to the disposal port; a secondary dust container accumulating dust; and a secondary electric blower that generates negative suction pressure in the dust transfer pipe via the
(Continued)

secondary dust container. At least one irregularly shaped ventilation groove that causes air to flow below the dust within the container body by the negative pressure generated by the secondary electric blower is provided to the inner surface of the bottom wall of the container body.

20 Claims, 10 Drawing Sheets

(51) Int. Cl.

| | |
|---|---|
| ***A47L 5/22*** | (2006.01) |
| ***A47L 9/04*** | (2006.01) |
| ***A47L 9/12*** | (2006.01) |
| ***A47L 9/14*** | (2006.01) |

(52) U.S. Cl.
CPC ..... *A47L 9/0477* (2013.01); *A47L 9/10* (2013.01); *A47L 9/122* (2013.01); *A47L 9/1409* (2013.01); *A47L 9/149* (2013.01); *A47L 9/28* (2013.01); *A47L 9/2884* (2013.01); *A47L 2201/022* (2013.01); *A47L 2201/024* (2013.01); *A47L 2201/04* (2013.01)

(58) Field of Classification Search
CPC ..... A47L 9/1409; A47L 9/2884; A47L 2201/022; A47L 2201/024; A47L 2201/04; A47L 9/10
See application file for complete search history.

(56) References Cited

FOREIGN PATENT DOCUMENTS

| | | | |
|---|---|---|---|
| JP | 2012-245344 | A | 12/2012 |
| JP | 2013-52238 | A | 3/2013 |
| JP | 2013-144028 | A | 7/2013 |
| JP | 2014-94233 | A | 5/2014 |

ELECTRIC VACUUM CLEANING APPARATUS

CROSS-REFERENCE TO RELATED APPLICATIONS

This application claims the benefit of priority of No. PCT/JP2015/072860, filed on Aug. 12, 2015, and the PCT application is based upon and claims the benefit of priority from Japanese Patent Application No. 2014-167653 filed on Aug. 20, 2014, the entire contents of each of which are incorporated herein by reference.

FIELD

An embodiment of the present invention relates to an electric vacuum cleaning apparatus.

BACKGROUND

There is known an autonomous robotic vacuum cleaner adapted to move on a surface to be cleaned and collect dust from the surface.

This conventional autonomous robotic vacuum cleaner includes a dust container detachably attached to a body casing and accumulates collected dust in the dust container. The user removes the dust container from the body casing and disposes of the dust collected in the dust container with opening a top lid of the dust container.

PRIOR ART DOCUMENTS

Patent Documents

Patent Document 1: Japanese Patent Laid-Open No. 2013-144028

SUMMARY

Problems to be Solved by the Invention

There is known an electric vacuum cleaning apparatus that includes an autonomous robotic vacuum cleaner and a station adapted to accumulate dust disposed from the autonomous robotic vacuum cleaner. This type of electric vacuum cleaning apparatus fluidly connects the dust container of the autonomous robotic vacuum cleaner to the station, so as to transfer dust from the autonomous robotic vacuum cleaner to the station.

The electric vacuum cleaning apparatus needs a dust disposal port in the dust container of the autonomous robotic vacuum cleaner, so as to fluidly connect the dust container of the autonomous robotic vacuum cleaner to the station. The preferable disposal port in the dust container is provided in a bottom wall of the dust container, which the dust in the dust container is typically accumulated on a bottom of the dust container.

However, except for cases where the disposal port extends over an entire area of a bottom face of the dust container, the disposal port may be provided in part of the bottom wall of the dust container. In such a case, the dust is deposited not only on a lid blocking the disposal port but also on an inner side of an unopen portion (part other than the disposal port) of the bottom wall. Even if dust is sucked by applying negative pressure from the station, the dust deposited on the unopen portion may sometimes be difficult to take out through the disposal port. For example, dust, such as clips left in a living room, higher in density than lint and trash may sometimes be accumulated along an inner surface of the bottom wall. The dust is not sucked toward the disposal port, and is difficult to take out through disposal port as an air flow around the dust by suction vacuum pressure is weak.

Means For Solving The Problems

To solve the problems described above, it is an object of the present invention to provide an electric vacuum cleaning apparatus capable of easily disposing of dust from a dust container of an autonomous robotic vacuum cleaner to a station.

DESCRIPTION OF EMBODIMENT

An embodiment of an electric vacuum cleaning apparatus according to the present invention will be described with reference to FIGS. 1 to 10.

Figure 1:
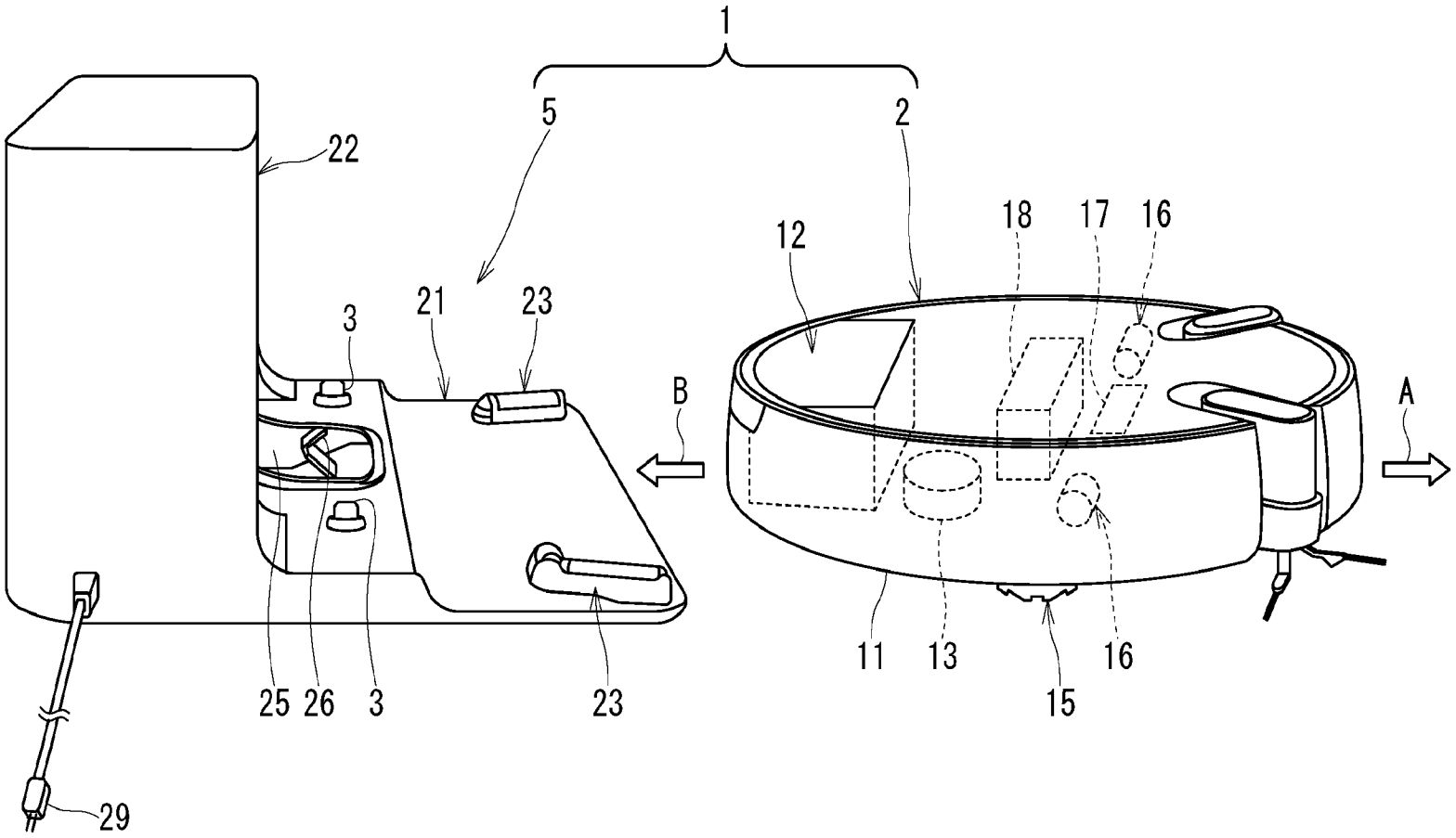
FIG. 1 is a perspective view showing an appearance of an electric vacuum cleaning apparatus according to an embodiment of the present invention.

FIG. 1 is a perspective view showing an appearance of the electric vacuum cleaning apparatus according to the embodiment of the present invention.

Figure 2:
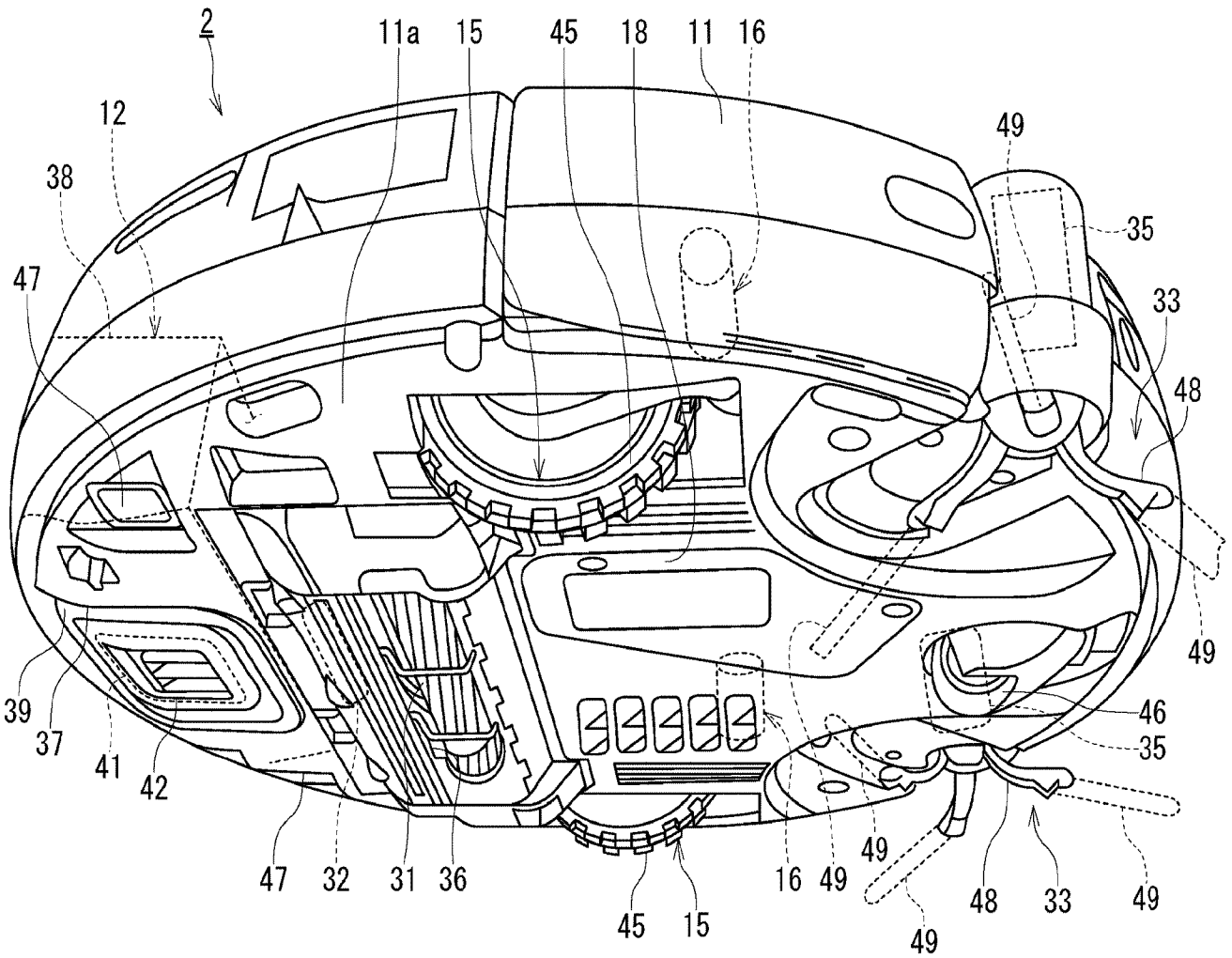
FIG. 2 is a perspective view showing a bottom face of an autonomous robotic vacuum cleaner of the electric vacuum cleaning apparatus according to the embodiment of the present invention.

As shown in FIGS. 1 and 2, the electric vacuum cleaning apparatus 1 according to the present embodiment includes an autonomous robotic vacuum cleaner 2 adapted to autonomously move on a surface to be cleaned, for example, a floor to collect dust from the surface to be cleaned and a station 5 equipped with charging electrodes 3 to charge the autonomous robotic vacuum cleaner 2. The autonomous robotic vacuum cleaner 2 moves autonomously all over the surface in a living room and subsequently homes to the station 5. The station 5 receives the dust collected by the autonomous robotic vacuum cleaner 2.

Note that the autonomous robotic vacuum cleaner 2 is electrically connected to the charging electrodes 3 of the station 5 at a home position of the autonomous robotic vacuum cleaner 2. When charging is necessary or cleaning of the living room is finished, the autonomous robotic vacuum cleaner 2 homes or returns to the home position. Note that the position where the autonomous robotic vacuum cleaner 2 is electrically connected to the charging electrodes 3 of the station 5 depends on a relative positional relationship between the autonomous robotic vacuum cleaner 2 moving autonomously and the station 5 that can be installed at any place.

An arrow A in FIG. 1 indicates an forward direction of the autonomous robotic vacuum cleaner 2 and an arrow B indicates a backward direction of the autonomous robotic vacuum cleaner 2. A width direction of the autonomous robotic vacuum cleaner 2 intersects the arrow A and the arrow B at right angles.

The autonomous robotic vacuum cleaner 2 moves forward to get separated from the station 5 and moves backward to get coupled to the station 5 when homing to the station 5.

The autonomous robotic vacuum cleaner 2 is a so-called robot cleaner. The autonomous robotic vacuum cleaner 2 includes a body casing 11 of a hollow disk shape, a primary dust container 12 detachably attached to rear part of the body casing 11, a primary electric blower 13 housed in the body casing 11 and connected to the primary dust container 12, running gear 15 adapted to move the autonomous robotic vacuum cleaner 2 on the surface, a driving force source 16 adapted to drive the running gear 15, a robot controller 17 adapted to control the driving force source 16 and thereby make the body casing 11 autonomously move on the surface, and a rechargeable battery 18 as a power supply.

The station 5 is installed in any location on the surface. The station 5 includes a base part 21 onto which the autonomous robotic vacuum cleaner 2 moving homeward a position (home position) electrically connected to the charging electrodes 3 runs, a dust collector 22 integrated with the base part 21, a roller pair 23 adapted to guide the autonomous robotic vacuum cleaner 2 moving toward the position (home position) where it is electrically connected to the charging electrodes 3, a dust transfer pipe 25 airtightly coupled to the primary dust container 12 of the autonomous robotic vacuum cleaner 2 in a positional relationship (home position) where it is electrically connected to the charging electrodes 3 (i.e., at the home position), a lever 26 protruding from inside the dust transfer pipe 25, and a power cord 29 that transmits electric power from a commercial alternating current power supply.

Next, the autonomous robotic vacuum cleaner 2 according to the embodiment of the present invention will be described in detail.

FIG. 2 is a perspective view showing a bottom face of the autonomous robotic vacuum cleaner of the electric vacuum cleaning apparatus according to the embodiment of the present invention.

As shown in FIG. 2, the autonomous robotic vacuum cleaner 2 of the electric vacuum cleaning apparatus 1 according to the embodiment of the present invention includes a rotating brush 31 provided on a bottom face 11*a* of the body casing 11, a rotating brush driving force source 32 adapted to drive the rotating brush 31, a pair of right and left spinning side brushes 33 provided on the bottom face 11*a* of the body casing 11, and a pair of right and left spinning side brush driving force sources 35 adapted to drive the respective spinning side brushes 33.

The disk-shaped body casing 11 is made, for example, of synthetic resin, and is able to easily rotate the surface. A laterally-oblong suction port 36 is provided in a midsection of a rear half of the bottom face 11*a* in a width direction.

The suction port 36 has a width dimension about two-thirds of a width dimension of the body casing 11, i.e., a diameter dimension. The suction port 36 is fluidly connected to the primary electric blower 13 via the primary dust container 12.

The body casing 11 has a dust container opening in the bottom face 11*a*. The dust container opening 37 is placed rearward of the suction port 36 at such a portion as to cover lower part of the primary dust container 12. The dust container opening 37 has a rounded rectangular shape. The dust container opening 37 partially exposes the primary dust container 12 attached to the body casing 11.

The primary dust container 12 accumulates dust sucked through the suction port 36 under suction vacuum pressure generated by the primary electric blower 13. The primary dust container 12 can use a filter adapted to filter out and collect dust or a separator adapted to accumulate dust by centrifugal separation (cyclone separation) or inertial separation such as separation by inertia force in a straight forward movement. The primary dust container 12 is placed in the rear part of the body casing 11 rearward of the suction port 36. The primary dust container 12 includes a container body 38 detachably attached to the body casing 11 and adapted to accumulate the dust collected by the autonomous robotic vacuum cleaner 2, a junction part 39 exposed from the dust container opening 37 when attached to the body casing 11, a disposal port 41 provided in the junction part 39 and used to dispose of the dust contained in the container body 38, and a disposal lid 42 for opening and closing the disposal port 41.

The running gear 15 includes a pair of right and left driving wheels 45 placed in the bottom face 11*a* of the body casing 11 and a caster 46 placed on the bottom face 11*a* of the body casing 11.

The driving wheels 45 protrude from the bottom face 11*a* of the body casing 11. The driving wheels 45 touch the surface when the autonomous robotic vacuum cleaner 2 is put on the surface. The driving wheels 45 are placed substantially in a midsection of the body casing 11 in a front-rear direction and placed closer to right and left flanks of the body casing 11, respectively, by avoiding a location in front of the suction port 36. Pivot shafts of the driving wheels 45 are placed on a straight line extending in a width direction of the body casing 11. The autonomous robotic vacuum cleaner 2 moves forward or backward with rotating the right and left driving wheels 45 in a same direction, while rotates on clockwise or counter-clockwise with rotating the right and left driving wheels 45 in directions opposite each other.

The caster 46 is a driven wheel configured to be able to swivel freely. The caster 46 is placed in front part substantially in a midsection of the body casing 11 in the width direction.

The driving force source 16 includes a pair of electric motors connected to the corresponding the driving wheels 45. The driving force source 16 drives the right and left driving wheels 45 independently of each other.

The robot controller 17 includes a microprocessor (not shown) as well as a storage device (not shown) adapted to store various arithmetic programs executed by the microprocessor and parameters. The robot controller 17 is electrically connected to the primary electric blower 13, rotating brush driving force source 32, driving force source 16, and spinning side brush driving force source 35.

The rechargeable battery 18 serves as a power supply for the primary electric blower 13, rotating brush driving force source 32, driving force source 16, spinning side brush driving force source 35, and robot controller 17. The rechargeable battery 18 is placed, for example, between the caster 46 and suction port 36. The rechargeable battery 18 is electrically connected to a pair of charging terminals 47 placed on the bottom face 11*a* of the body casing 11. The rechargeable battery 18 is charged when the charging terminals 47 are connected to the charging electrodes 3 of the station 5.

The rotating brush 31 is provided in the suction port 36. The rotating brush 31 is a shaft-shaped brush rotatable around a rotation center axis extending in the width direction of the body casing 11. The rotating brush 31 may include a long shank (not shown) and plural brush tufts (not shown) that extend in a radial direction of the shank by being arranged spirally in a longitudinal direction of the shank. The rotating brush 31 protrudes from the suction port 36, reaching below the bottom face 11*a* of the body casing 11. The rotating brush 31 brings comes into contact with the surface to be cleaned with the autonomous robotic vacuum cleaner 2 placed on the surface.

The rotating brush driving force source 32 is housed in the body casing 11.

The spinning side brushes 33 are placed on the corresponding right and left flanks with respect to the forward direction of the rotating brush 31. The spinning side brushes 33 are auxiliary cleaning brushes adapted to scrape up the dust from the surfaces beside a wall inaccessible by the rotating brush 31 and lead the dust to the suction port 36. Each of the spinning side brushes 33 includes a brush base 48 provided with a rotation center leaning slightly forward with respect to a perpendicular to the surface and, for example, three linear brushes 49 radially protruding in a radial direction of the brush base 48.

The right and left brush bases 48 are placed forward of the suction port 36 and right and left driving wheels 45, while rearward of the caster 46. The right and left brush bases 48 are placed to the corresponding the right and left of the suction port 36. The rotation center axes of the brush bases 48 lean slightly forward with respect to the perpendicular to the surface. Consequently, the linear brushes 49 turn along a plane leaning slightly forward with respect to the surface. In the linear brush 49 turning ahead of the brush base 48, the closer to a tip of the linear brush 49 is more strongly pressed against the surface. In the linear brush 49 turning behind the brush base 48, the closer to the tip of the linear brush 49 is farther from the surface.

The plural linear brushes 49 are placed radially, for example, in three directions at equal intervals from the brush base 48. Note that the spinning side brush 33 on each brush base 48 may have four or more linear brushes 49. Each linear brush 49 has plural brush hairs serving as cleaning members on the tip side. The brush hairs turn by generating traces spreading outward of outer peripheral edges of the body casing 11.

Each of the spinning side brush driving force sources 35 is equipped with a rotating shaft connected to the brush base 48 of the spinning side brush 33 with protruding downward. Each spinning side brush driving force source 35 rotates the spinning side brush 33 so as to scrape dust into the suction port 36 from the surface.

Next, the station 5 according to the embodiment of the present invention will be described in detail.

Figure 3:
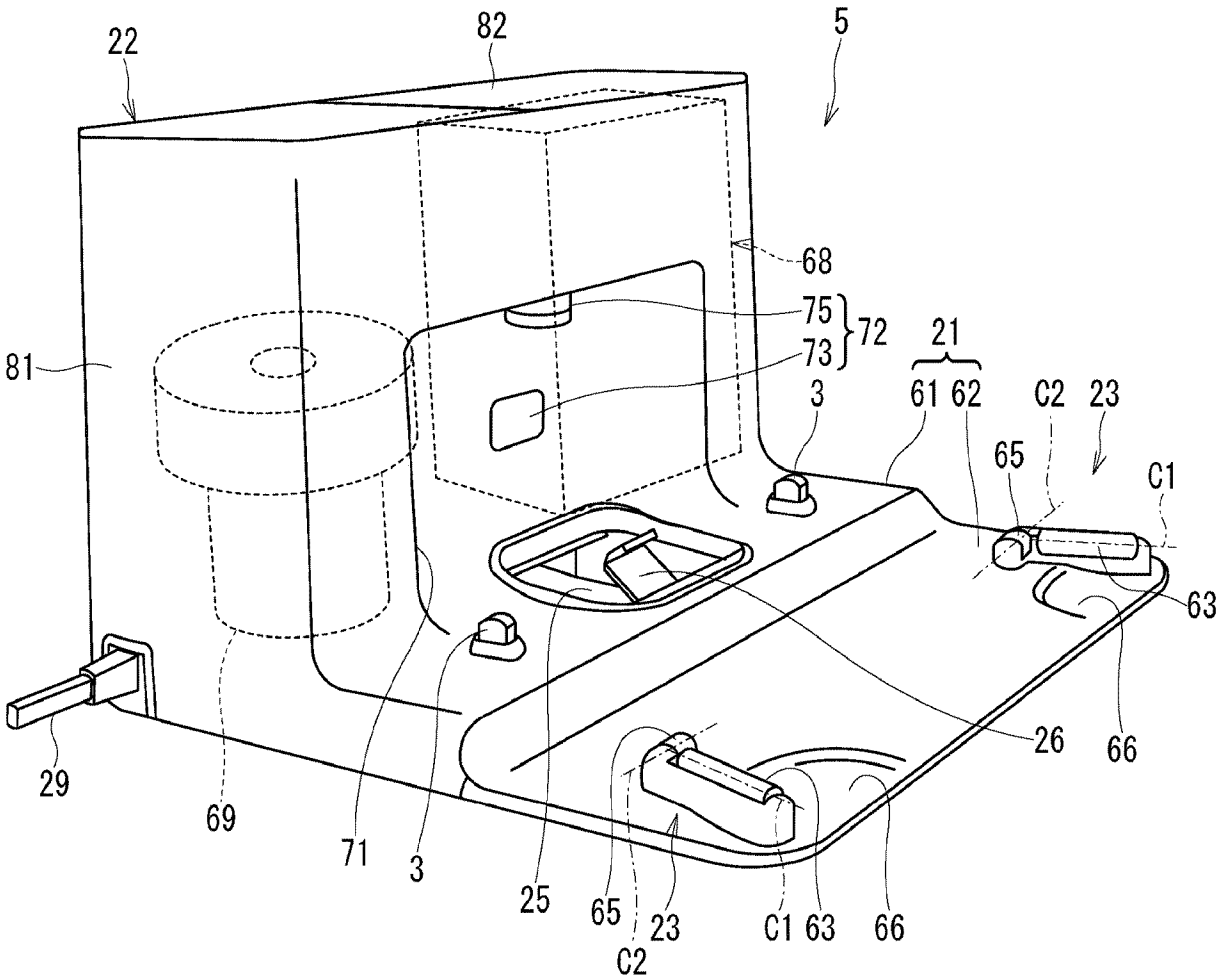
FIG. 3 is a perspective view showing a station of the electric vacuum cleaning apparatus according to the embodiment of the present invention.

FIG. 3 is a perspective view showing the station of the electric vacuum cleaning apparatus according to the embodiment of the present invention.

As shown in FIG. 3, the base part 21 of the station 5 according to the present embodiment spreads in a rectangular shape by jutting forward from the station 5. The base part 21 includes a high floor part 61 connected to a bottom of the dust collector 22 and a low floor section 62 jutting out from the high floor part 61. The low floor section 62 and high floor part 61 extend in the width direction of the station 5 in strips. The roller pair 23 is placed on the low floor section 62. The charging electrodes 3 and an inlet of the dust transfer pipe 25 are placed on the high floor part 61.

The autonomous robotic vacuum cleaner 2 runs onto the low floor section 62 with the pair of driving wheels 45 while moving backward and arrives at the home position in a posture in which the primary dust container 12 is placed above the high floor part 61.

The roller pair 23 is placed on each of right and left ends of the low floor section 62 of the base part 21 and in each of right and left front end portions of the low floor section 62 of the base part 21.

The roller pair 23 includes a pair of cross direction rollers 63 adapted to guide the autonomous robotic vacuum cleaner 2 in the width direction, i.e., in a direction intersecting a direction (backward direction) oriented toward the position (home position) where the autonomous robotic vacuum cleaner 2 is electrically connected to the charging electrodes 3, and a pair of stopping rollers 65 adapted to idle the driving wheels 45 when the autonomous robotic vacuum cleaner 2 arrives at the position (home position) where the autonomous robotic vacuum cleaner 2 is electrically connected to the charging electrodes 3. The roller pair 23, i.e., the cross direction rollers 63 and the stopping rollers 65, protrudes from the base part 21 acting as a ground plane for the driving wheels 45.

The cross direction rollers 63 have non-parallel rotation centers C1 whose spacing distance decreases toward the position (home position) where the autonomous robotic vacuum cleaner 2 is electrically connected to the charging electrodes 3. In other words, the cross direction rollers 63 have rotation centers C1 which approach each other as the cross direction rollers 63 approach the dust collector 22 from the side of the base part 21.

The stopping rollers 65 have rotation centers C2 that intersect the direction toward the position (home position) where the autonomous robotic vacuum cleaner 2 is electrically connected to the charging electrodes 3. When the autonomous robotic vacuum cleaner 2 arrives at the position (home position) where the autonomous robotic vacuum cleaner 2 is electrically connected to the charging electrodes 3, the pair of stopping rollers 65 stops the autonomous robotic vacuum cleaner 2 from proceeding (moving backward) with idling the driving wheels 45. Note that the rotation centers C2 of the stopping rollers 65 are desirably at right angles to the direction toward the position (home position) where the autonomous robotic vacuum cleaner 2 is electrically connected to the charging electrodes 3.

The base part 21 includes concavo-convex running surfaces 66 configured to reduce respective ground contact areas of the driving wheels 45 when the autonomous robotic vacuum cleaner 2 is heading toward the position (home position) where the autonomous robotic vacuum cleaner 2 is electrically connected to the charging electrodes 3. The running surfaces 66 are provided in a portion surrounded by the roller pair 23, i.e., the pair of cross direction rollers 63 and pair of stopping rollers 65. The running surfaces 66 provided in part of the base part 21 are an uneven surface patterned by plural lines, a lattice-patterned uneven surface, or an uneven surface patterned by plural hemispheres.

The dust collector 22 includes a secondary dust container 68 adapted to accumulate dust disposed of from the primary dust container 12 through the dust transfer pipe 25, a secondary electric blower 69 housed in the dust collector 22 and connected to the secondary dust container 68, and the power cord 29 adapted to transmit electric power from a commercial alternating current power supply to the secondary electric blower 69 and charging electrodes 3.

The dust collector 22 is placed rearward of the station 5. The dust collector 22 is a rounded rectangular boxlike body extending above the base part 21. A front wall of the dust collector 22 includes an arc-shaped recess 71 corresponding to a rear end of the autonomous robotic vacuum cleaner 2. The inlet of the dust transfer pipe 25 extends to the recess 71 from the high floor part 61 of the base part 21. The recess 71 is provided with a homing detector adapted to detect whether the autonomous robotic vacuum cleaner 2 has arrived at the position (home position) where the autonomous robotic vacuum cleaner 2 is electrically connected to the charging electrodes 3. The homing detector 72 is a so-called object sensor adapted to detect a relative distance from the autonomous robotic vacuum cleaner 2 using visible light or infrared-rays. The homing detector 72 includes a first sensor assembly 73 adapted to detect the relative distance from the autonomous robotic vacuum cleaner 2 in a front direction of the dust collector 22 and a second sensor assembly 75 adapted to detect the relative distance from the autonomous robotic vacuum cleaner in a height direction of the dust collector 22.

The dust collector 22 includes a lid 82 adapted to conceal the secondary dust container 68 housed in a main body 81. The lid 82 opens and closes part of a ceiling of the dust collector 22, specifically, a right half of the dust collector 22. The secondary dust container 68 is placed below the lid 82.

The pair of charging electrodes 3 are placed on the corresponding opposite sides of the inlet of the dust transfer pipe 25. The charging electrodes 3 are placed in front of the corresponding the right and left edges of the recess 71.

Figure 4:
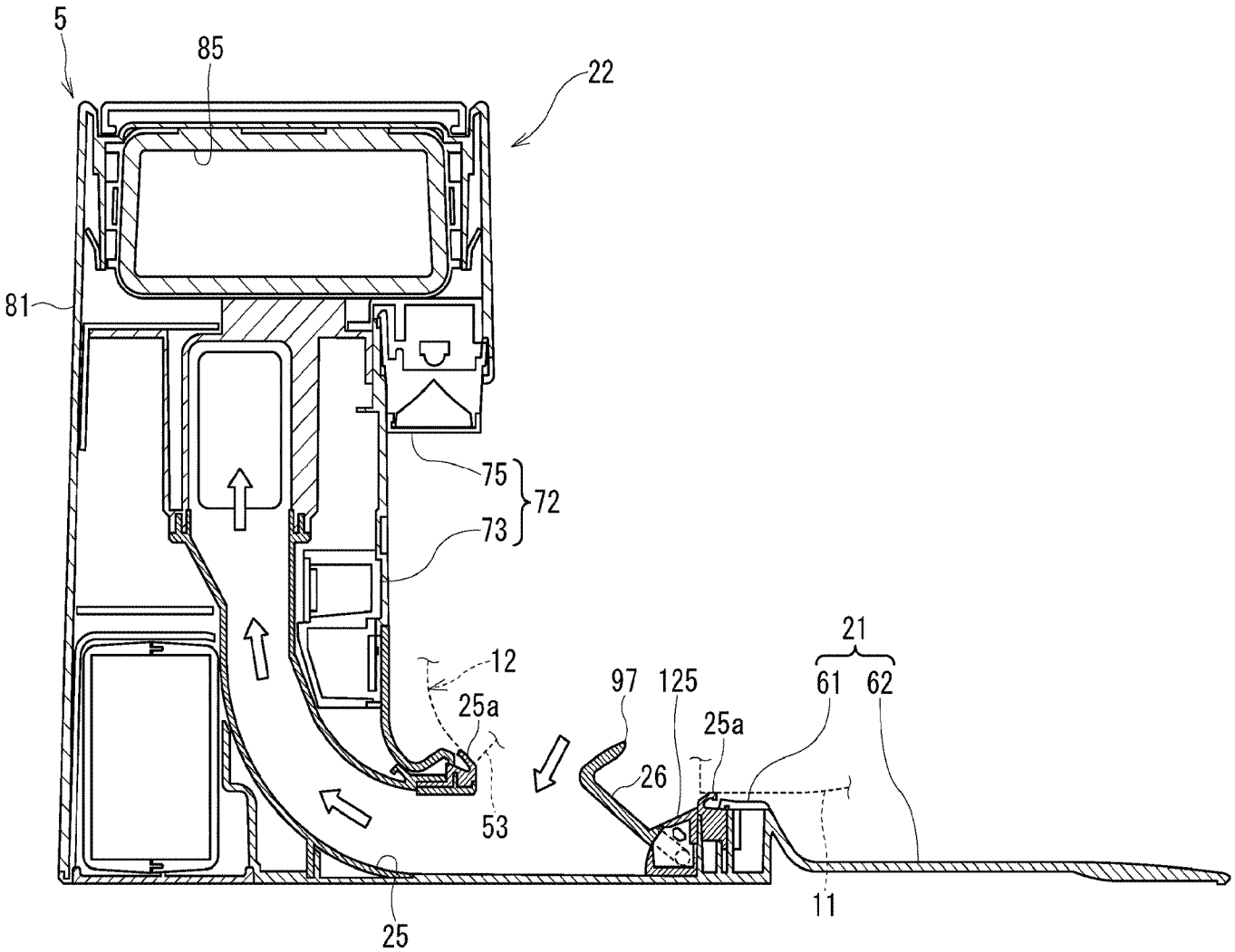
FIG. 4 is a longitudinal sectional view showing the station of the electric vacuum cleaning apparatus according to the embodiment of the present invention.

FIG. 4 is a longitudinal sectional view showing the station of the electric vacuum cleaning apparatus according to the embodiment of the present invention.

Figure 5:
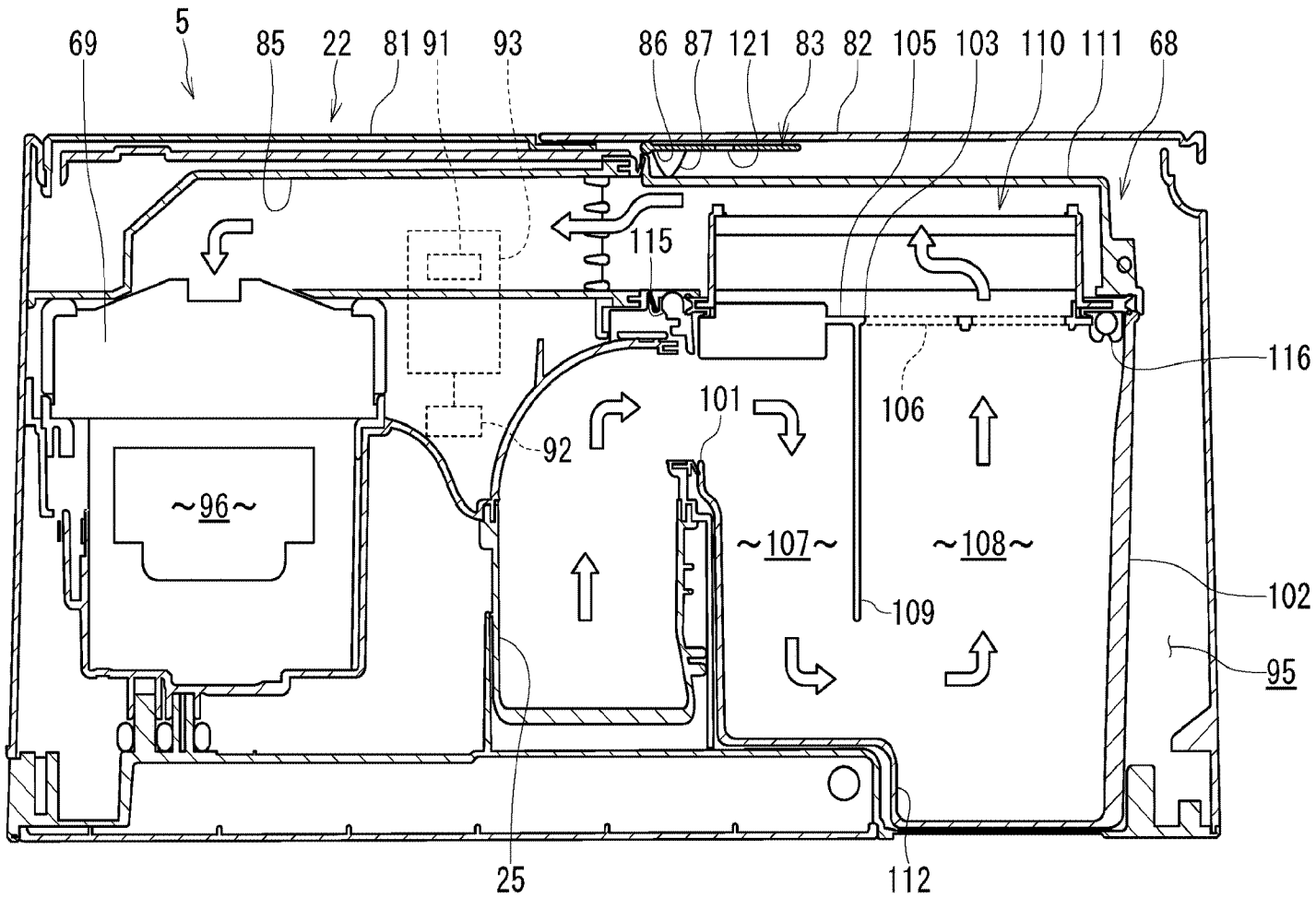
FIG. 5 is a cross-sectional view showing the station of the electric vacuum cleaning apparatus according to the embodiment of the present invention.

FIG. 5 is a cross-sectional view showing the station of the electric vacuum cleaning apparatus according to the embodiment of the present invention.

As shown in FIGS. 4 and 5, the dust collector 22 of the station 5 according to the embodiment of the present invention includes the main body 81 provided with the dust transfer pipe 25 as an air passage (air course) adapted to guide the dust, the secondary dust container 68 removably contained in the main body 81 and detachably coupled to the dust transfer pipe 25, the secondary electric blower 69 adapted to generate suction negative pressure in the dust transfer pipe 25 through the secondary dust container 68, the lid 82 adapted to conceal the secondary dust container 68 housed in the main body 81, an erroneous suction preventing mechanism 83 provided on the lid 82 and adapted to block the air passage on a suction side of the secondary electric blower 69 when the secondary dust container 68 has been taken out of the main body 81, and a downstream pipe 85 adapted to fluidly connect the secondary electric blower 69 to the secondary dust container 68.

The dust collector 22 includes a claw 87 provided on the erroneous suction preventing mechanism 83. The claw 87 turns a sealing surface 86 that is adapted to block the air passage on the suction side of the secondary electric blower 69 toward the secondary dust container 68 with restricting a swing angle of the erroneous suction preventing mechanism 83 when the lid 82 touches the secondary dust container 68 while it is closing.

The dust collector 22 includes a pressure detecting section 91 adapted to detect suction vacuum pressure of the secondary electric blower 69, an alarm section 92 adapted to sound an alarm if the dust accumulated in the secondary dust container 68 reaches a pre-determined amount, and a controller 93 adapted to operate the alarm section 92 when a detection result produced by the pressure detecting section 91 indicates a pressure lower than a pre-determined suction vacuum pressure.

The main body 81 is short in a depth direction (direction in which the autonomous robotic vacuum cleaner 2 retreats when homing) and long in the width direction. The main body 81 has a dust container chamber 95 adapted to house the secondary dust container 68 in one half of the main body 81 in the width direction, specifically, in a right half. The main body 81 has a blower chamber 96 adapted to house the secondary electric blower 69 in another half of the main body 81 in the width direction, specifically, in a left half.

The dust transfer pipe 25 is put in contact with the junction part 39 of the primary dust container 12 and airtightly coupled to the disposal port 41 in the positional relationship in which the autonomous robotic vacuum cleaner 2 is electrically connected to the charging electrodes 3 (at the home position). A sealing member 25*a* annular in shape is provided on an open edge of the dust transfer pipe 25, i.e., at an inlet of the dust transfer pipe 25. The sealing member 25*a* is placed in tight contact with the junction part 39 in the positional relationship in which the autonomous robotic vacuum cleaner 2 is electrically connected to the charging electrodes 3 (at the home position). The dust transfer pipe 25 extends rearward from the inlet disposed on the high floor part 61 of the base part 21 to reach within the dust collector 22. The dust transfer pipe 25 extends upward between the dust container chamber 95 and blower chamber 96 while bending in the dust collector 22 and reaches a flank of the secondary dust container 68. The dust transfer pipe 25 includes the inlet opening upward above the station 5 and an outlet opening laterally toward the secondary dust container 68.

A lever 26 placed at the inlet of the dust transfer pipe 25 includes a hook 97 extending upward in a front direction of the dust collector 22.

The secondary dust container 68 includes a dust container 102 whose top face is open and which has a suction port 101 in a side face, a lid 105 adapted to close the top face of the dust container 102 and provided with a discharge port 103, a net filter 106 installed at the discharge port 103, a partition plate 109 hanging from the lid 105 toward a bottom face of the dust container 102 and adapted to divide inner part of the dust container 102 into an upstream passage 107 directly connecting to the suction port 101 in the dust container 102 and a downstream passage 108 connecting to the discharge port 103 and connect the upstream passage 107 and downstream passage 108 with each other at a bottom of the dust container 102, a secondary filter 110 configured to connect to the discharge port 103 and hang over the lid 105, and a cover pipe 111 adapted to define a downstream air passage of the secondary filter 110.

The dust container 102 includes a protruding section 112 placed below the downstream passage 108 and configured to bulge below a bottom of the upstream passage 107.

The secondary filter 110 is connected to the downstream pipe 85.

The secondary dust container 68 includes a first hinge mechanism 115 adapted to open and close the lid 105, partition plate 113, and secondary filter 110 as a unit, and a second hinge mechanism 116 adapted to make the lid 105 and partition plate 113 swing as a unit in order to open and close a space on the upstream side of a filtering surface of the secondary filter 110.

The cover pipe 111 serves also as an air passage adapted to connect the downstream air passage of the secondary filter 110 to the downstream pipe 85. The cover pipe 111 is swingably supported together with the lid 105 by the first hinge mechanism 115.

The first hinge mechanism 115 is placed above the suction port 101 at an upper end of a side wall of the dust container 102 provided with the suction port 101.

The second hinge mechanism 116 is installed at an opposite end of the lid 105 from the first hinge mechanism 115.

The secondary electric blower 69 is housed in the blower chamber 96 of the main body 81 with the suction port facing upward.

The downstream pipe 85 is an air passage on the suction side of the secondary electric blower 69. The downstream pipe 85 is placed above the dust transfer pipe 25 and extends in the width direction in the main body 81 of the dust collector 22. An inlet of the downstream pipe 85 is connected to the dust container chamber 95. An outlet of the downstream pipe 85 is connected to the suction port of the secondary electric blower 69. When the secondary dust container 68 is housed in the dust container chamber 95, the downstream pipe 85 is coupled to a downstream side of the secondary filter 110 of the secondary dust container 68.

The lid 82 is installed swingably on the main body 81. The lid 82 opens and closes an opening in the top face of the dust container chamber 95 adapted to house the secondary dust container 68.

The erroneous suction preventing mechanism 83 is installed swingably on the lid 82.

The erroneous suction preventing mechanism 83 has a ventilation hole 121 intended to avoid complete blocking of the air passage on the suction side of the secondary electric blower 69.

When the autonomous robotic vacuum cleaner 2 returns to the home position of the station 5, the charging terminal 47 of the autonomous robotic vacuum cleaner 2 is electrically connected to the charging electrodes 3 of the station 5. Meanwhile, the dust transfer pipe 25 of the station 5 is connected to the junction part 39 of the primary dust container 12. Subsequently, the station 5 drives the secondary electric blower 69, and thereby sucks air in the direction of solid arrows in FIGS. 4 and 5 to move the dust in the primary dust container 12 to the secondary dust container 68. The secondary dust container 68 traps coarse dust of coarse particles with the net filter 106 and accumulates the dust in the downstream passage 108. The dust trapped by the net filter 106 is accumulated with being layered from an upper side to lower side of the downstream passage 108. Also, the dust trapped by the net filter 106 is compressed with being pressed against the net filter 106 due to a flow of air. The compressed coarse dust traps fine dust of fine particles contained in air by serving as a fine-mesh filter. While some of the fine dust trapped by the compressed coarse dust clings to the coarse dust, other of the fine dust falls off the coarse dust and reaches below the downstream passage 108. The fine dust falling off the coarse dust piles up on the protruding section 112, which is located below the downstream passage 108. Around the protruding section 112, air flowing from the upstream passage 107 to the downstream passage 108 in the secondary dust container 68 in a U-shaped manner tends to stagnate. Consequently, the fine dust piling up on the protruding section 112 tends to gather on the protruding section 112 without being blown up by airflow.

The fine dust of fine particles passing through the net filter 106 and fine dust passing through the compressed coarse dust are trapped with the secondary filter 110.

Figure 6:
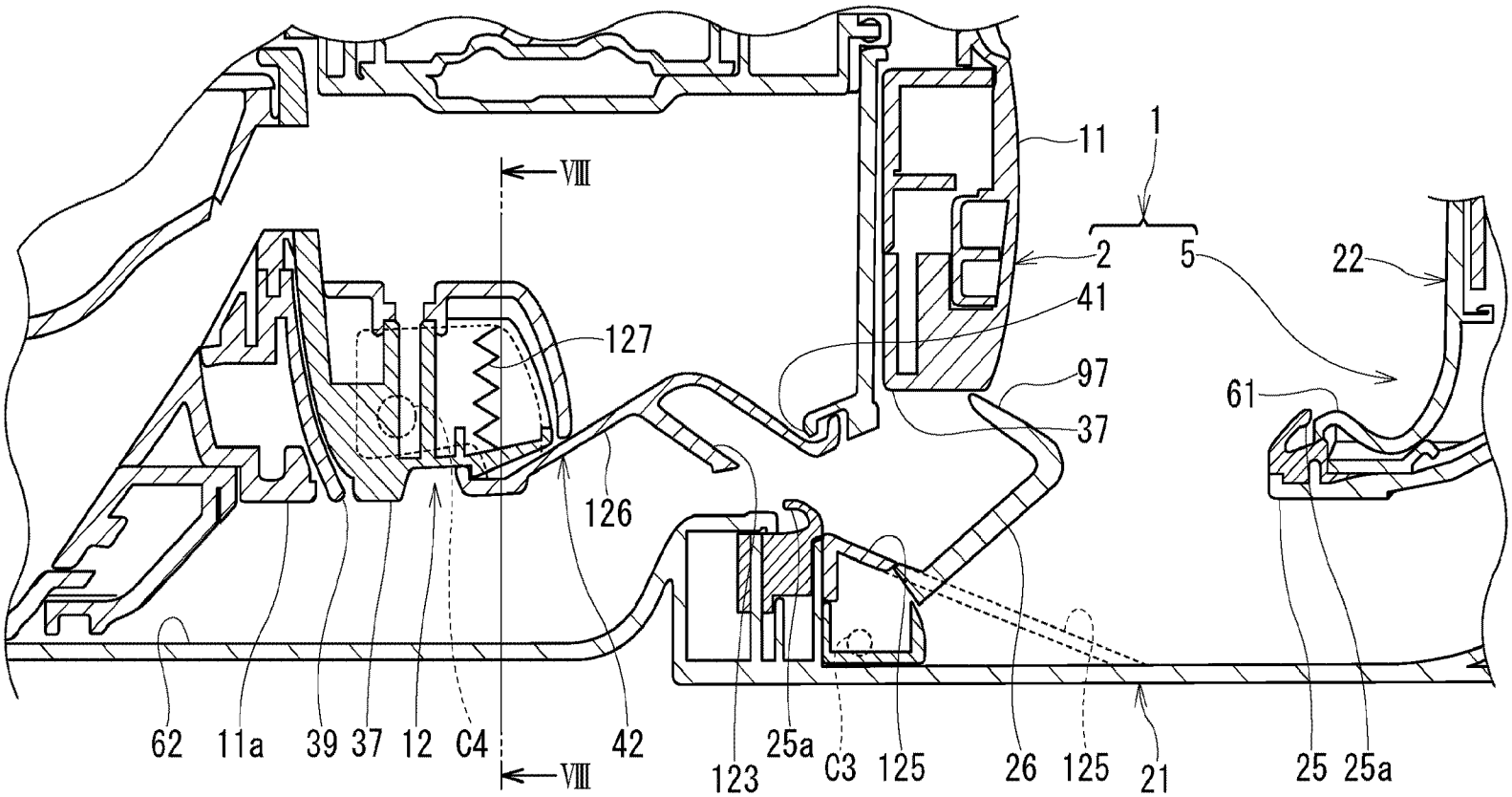
FIG. 6 is a longitudinal sectional view showing a junction between the autonomous robotic vacuum cleaner and the station of the electric vacuum cleaning apparatus according to the embodiment of the present invention.
Figure 7:
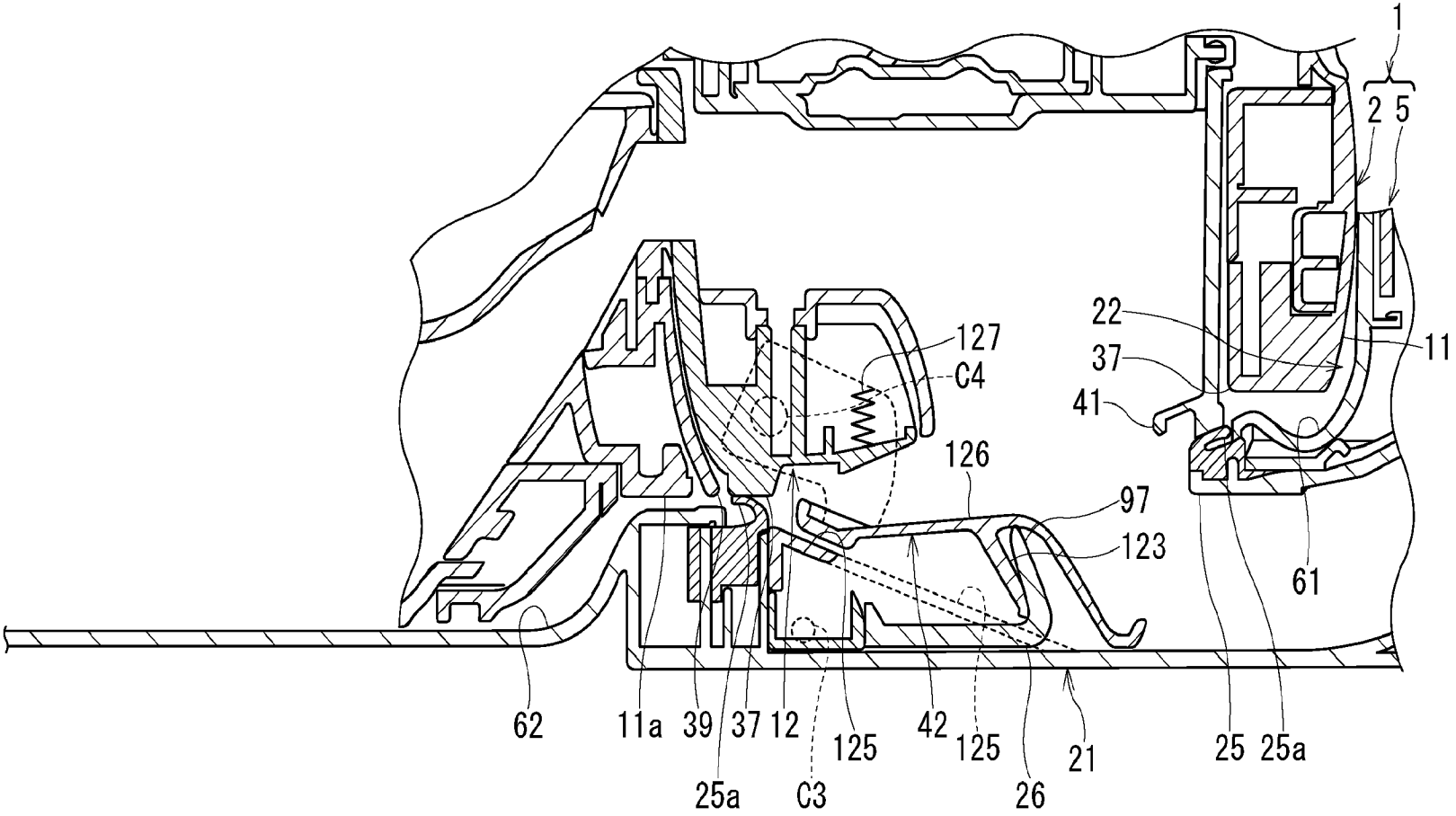
FIG. 7 is a longitudinal sectional view showing a junction between the autonomous robotic vacuum cleaner and the station of the electric vacuum cleaning apparatus according to the embodiment of the present invention.

FIGS. 6 and 7 are longitudinal sectional views showing a junction between the autonomous robotic vacuum cleaner and station of the electric vacuum cleaning apparatus according to the embodiment of the present invention.

FIGS. 6 and 7 show how the autonomous robotic vacuum cleaner 2 approaches the position where the autonomous robotic vacuum cleaner 2 is electrically connected to the charging electrodes 3, i.e., the home position. When the autonomous robotic vacuum cleaner 2 moves away from the station 5, the situation in FIGS. 6 and 7 is reversed.

As shown in FIGS. 6 and 7, the primary dust container 12 of the autonomous robotic vacuum cleaner 2 according to the present embodiment includes the container body 38 detachably attached to the body casing 11 and adapted to accumulate the dust collected by the autonomous robotic vacuum cleaner 2, the junction part 39 exposed from the dust container opening 37 when attached to the body casing 11, the disposal port 41 provided in the junction part 39 and used to dispose of the dust contained in the container body 38, and the disposal lid 42 used to open and close the disposal port 41.

The junction part 39 is integrally formed with the container body 38. The junction part 39 protrudes in the form of a rounded rectangle corresponding to the dust container opening 37. When the primary dust container 12 is mounted in the body casing 11, the junction part 39 is fitted in the dust container opening 37. The junction part 39 has an outer peripheral portion flush with an external surface of the body casing 11 and has a recess in a peripheral portion of the disposal port 41. The disposal port 41 is provided in a center of the recess. Also, the disposal lid 42 is placed on the recess.

Note that it is sufficient if the junction part 39 is placed facing the dust container opening 37 when the primary dust container 12 is mounted in the body casing 11. In this case, the junction part 39 is placed inside the body casing 11 at a place where the junction part 39 can be seen through the dust container opening 37. Preferably the dust transfer pipe 25 has such a protruding length as to be able to reach the junction part 39 through the dust container opening 37.

The disposal port 41 opens downward below the autonomous robotic vacuum cleaner 2 when the primary dust container 12 is mounted in the body casing 11.

The disposal port 41 is placed on a side closer to the station 5 than a center of the autonomous robotic vacuum cleaner 2 in the positional relationship in which the autonomous robotic vacuum cleaner 2 is electrically connected to the charging electrodes 3 (at the home position). That is, when the autonomous robotic vacuum cleaner 2 approaches the station 5 with moving backward and the pair of driving wheels 45 run onto the base part 21 of the station 5, the disposal port 41 approaches the dust collector 22 of the station 5 earlier than the center of the autonomous robotic vacuum cleaner 2.

The disposal lid 42 is exposed outside the autonomous robotic vacuum cleaner 2 and is flush with the external surface of the body casing 11. The disposal lid 42 includes a lever catch 123 adapted to catch the lever 26 of the station 5. Note that, as with the junction part 39, the disposal lid 42 may be placed at a location facing the dust container opening 37 when mounted in the body casing 11. In this case, the disposal lid 42 is placed inside the body casing 11 at a place where the junction part 39 can be seen through the dust container opening 37.

The lever 26 of the station 5 according to the present embodiment is caught on the disposal lid 42 of the autonomous robotic vacuum cleaner 2 en route to the position (home position) where the autonomous robotic vacuum cleaner 2 is electrically connected to the charging electrodes 3 and opens the disposal lid 42 and thereby fluidly connects the disposal port 41 and dust transfer pipe 25 when the autonomous robotic vacuum cleaner 2 arrives at the position (home position) where the autonomous robotic vacuum cleaner 2 is electrically connected to the charging electrodes 3 (FIG. 7).

The disposal lid 42 of the autonomous robotic vacuum cleaner 2 and the lever 26 of the station 5 swing around rotation center axes C3 and C4 intersecting the direction toward the position where the autonomous robotic vacuum cleaner 2 is electrically connected to the charging electrodes 3. Note that desirably the rotation center axis C4 of the disposal lid 42 and the rotation center axis C3 of the lever 26 are at right angles to the direction toward the position (home position) where the autonomous robotic vacuum cleaner 2 is electrically connected to the charging electrodes 3.

The rotation center axis C3 of the lever 26 is placed in the first edge portion reached by the autonomous robotic vacuum cleaner 2 out of opening edge portions of the dust transfer pipe 25 in the direction toward the position (home position) where the autonomous robotic vacuum cleaner 2 is electrically connected to the charging electrodes 3, i.e., in a front end portion of an opening edge of the dust transfer pipe 25.

The rotation center axis C3 of the lever 26 is supported movably in the direction toward the position (home position) where the autonomous robotic vacuum cleaner 2 is electrically connected to the charging electrodes 3. That is, as the rotation center axis C3 of the lever 26 moves in the direction toward the position (home position) where the autonomous robotic vacuum cleaner 2 is electrically connected to the charging electrodes 3, the hook 97 is caught on the lever catch 123 without being affected by variation in positional accuracy in homing control of the autonomous robotic vacuum cleaner 2.

The rotation center axis C3 of the lever 26 is covered by a shaft cover 125 provided in the first edge portion reached by the autonomous robotic vacuum cleaner 2 out of opening edge portions of the dust transfer pipe 25 in the direction toward the position (home position) where the autonomous robotic vacuum cleaner 2 is electrically connected to the charging electrodes 3, i.e., in the front end portion of the opening edge of the dust transfer pipe 25.

The rotation center axis C4 of the disposal lid is placed on behind of the disposal lid 42 in the direction toward the position (home position) where the autonomous robotic vacuum cleaner 2 is electrically connected to the charging electrodes 3, in other words, in that part of the disposal lid 42 which approaches the dust transfer pipe 25 the latest. The rotation center axis C4 of the disposal lid 42 is placed on a side farther than the lever catch 123 in the direction toward the position (home position) where the autonomous robotic vacuum cleaner 2 is electrically connected to the charging electrodes 3. The rotation center axis C4 of the disposal lid 42 is placed on farther than a lid body 126 of the disposal lid 42 in the direction toward the position (home position) where the autonomous robotic vacuum cleaner 2 is electrically connected to the charging electrodes 3, where the lid body 126 is configured to come into and out of contact with the disposal port 41.

The disposal lid 42 serves as an inclined surface adapted to guide dust from the container body 38 of the autonomous robotic vacuum cleaner 2 to the dust transfer pipe 25 (FIG. 7) when opened by the lever 26 with the rotation center axis C3 of the lever 26 and the rotation center axis C4 of the disposal lid 42 placed in this way.

A spring force of a coiled spring 127 is acting on the disposal lid 42 to be closed. The disposal lid 42 is opened when a propulsive force moving the autonomous robotic vacuum cleaner 2 toward the position (home position) where the autonomous robotic vacuum cleaner 2 is electrically connected to the charging electrodes 3 overcomes the spring force of the coiled spring 127. When the disposal lid 42 is opened by the lever 26, the coiled spring 127 is compressed to store storing energy. When the autonomous robotic vacuum cleaner 2 leaves the station 5 and the lever 26 comes off the lever catch 123, the coiled spring 127 releases energy and closes the disposal lid 42.

A spring force of a coiled spring (not shown) is acting on the lever 26 in such a direction as to raise the lever 26 (FIG. 6). The lever 26 is pushed down when the propulsive force moving the autonomous robotic vacuum cleaner 2 toward the position (home position) where the autonomous robotic vacuum cleaner 2 is electrically connected to the charging electrodes 3 overcomes the spring force of the coiled spring. When the disposal lid 42 is opened by the lever 26, the coiled spring is compressed to store storing energy. When the autonomous robotic vacuum cleaner 2 leaves the station 5 and the lever 26 comes off the lever catch 123, the coiled spring releases energy and raises the lever 26.

Figure 8:
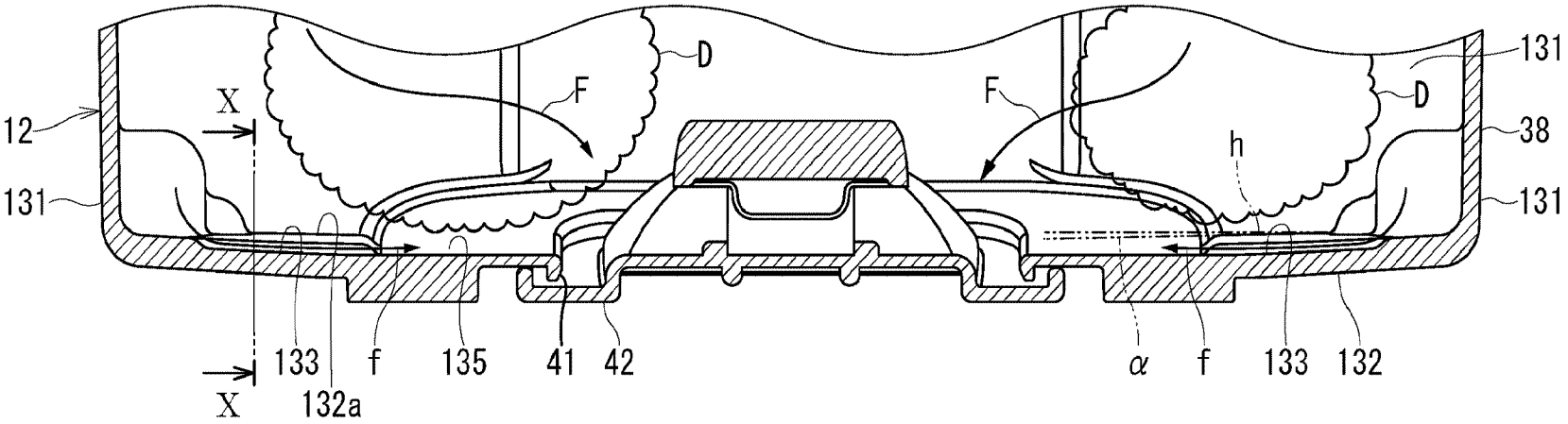
FIG. 8 is a cross-sectional view showing a primary dust container of the electric vacuum cleaning apparatus according to the embodiment of the present invention.

FIG. 8 is a cross-sectional view taken along line VIII-VIII in FIG. 6, showing the primary dust container of the electric vacuum cleaning apparatus according to the embodiment of the present invention.

Figure 9:
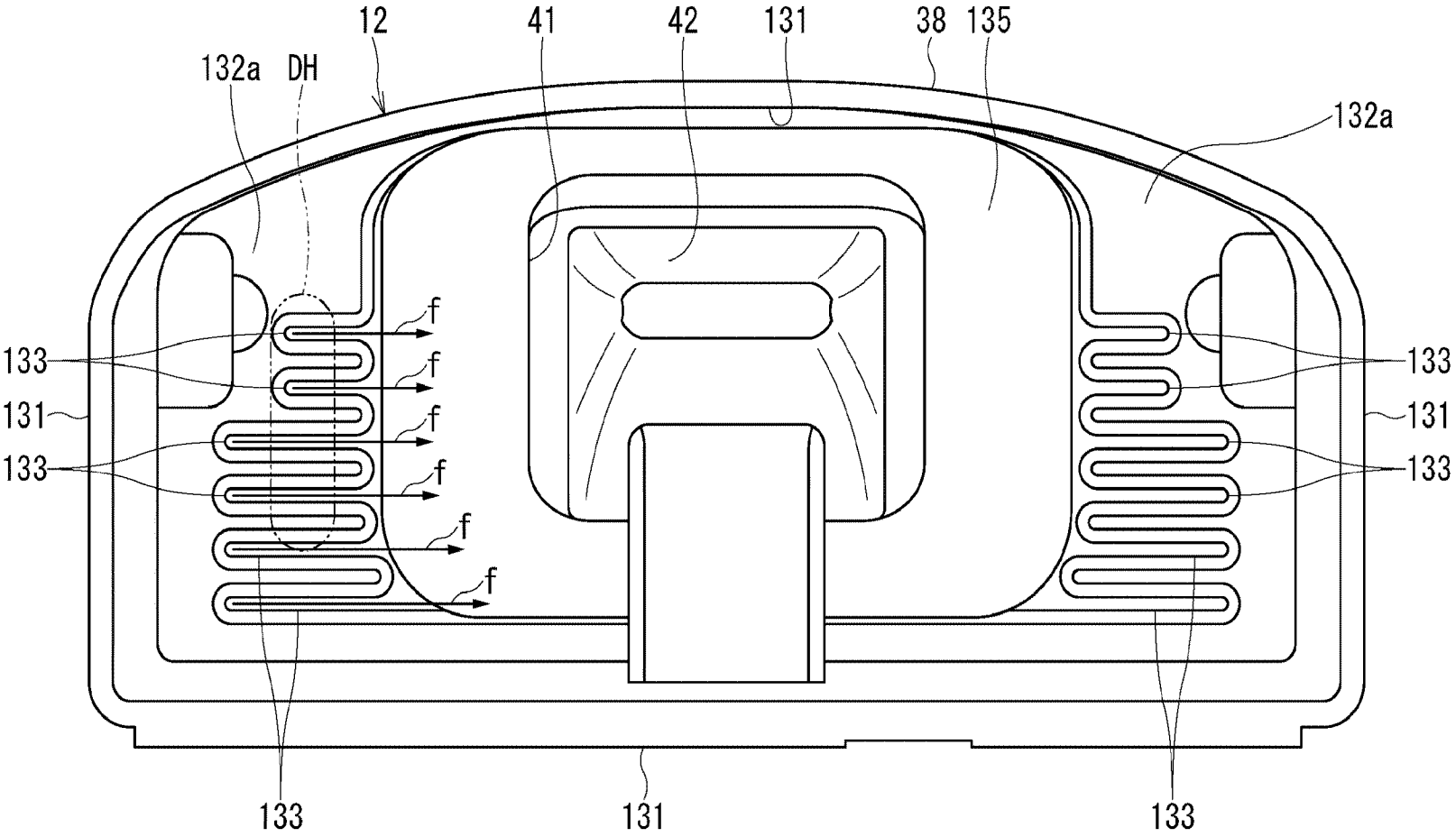
FIG. 9 is a plan view showing a container body of the electric vacuum cleaning apparatus according to the embodiment of the present invention.

FIG. 9 is a plan view showing the container body of the electric vacuum cleaning apparatus according to the embodiment of the present invention.

Figure 10:
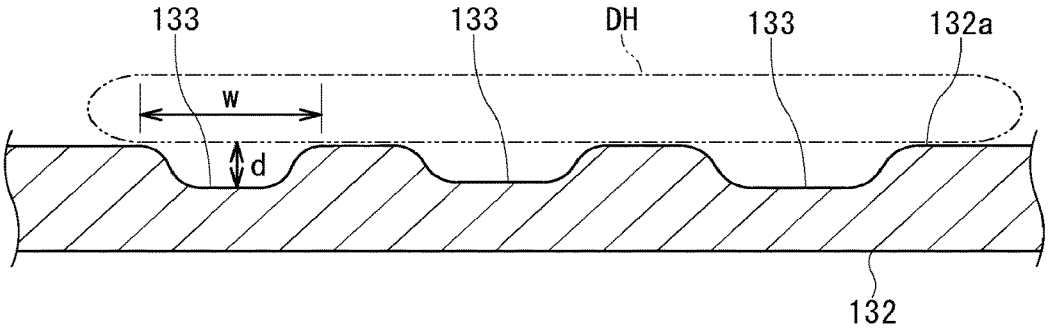
FIG. 10 is a sectional view showing the container body of the electric vacuum cleaning apparatus according to the embodiment of the present invention.

FIG. 10 is a sectional view taken along line X-X in FIG. 8, showing the container body of the electric vacuum cleaning apparatus according to the embodiment of the present invention.

As shown in FIGS. 8 to 10, the primary dust container 12 of the autonomous robotic vacuum cleaner 2 according to the present embodiment has the container body 38 substantially rectangular in shape.

The container body 38 has four side walls 131 planar in shape and a bottom wall 132. A filtration filter (not shown) or a cyclone separator (not shown) adapted to separate dust D sucked into the container body 38 through the suction port 36 in the body casing 11 from air is placed at a location corresponding to a top wall of the container body 38.

The bottom wall 132 of the container body 38 has the disposal port 41 in a midsection. The disposal port 41 is openably blocked by the disposal lid 42 swingably supported on the container body 38.

An inner surface 132*a* of the bottom wall 132 of the container body 38 declines a toward the disposal port 41, forming a funnel shape (horizontal line h). At least one ventilation groove 133 is provided in the inner surface 132*a* of the bottom wall 132 of the container body 38 to cause air to flow below the dust D in the container body 38 under negative pressure produced by the secondary electric blower 69.

The ventilation groove 133 is a groove-shaped depression connecting to a concave portion 135 surrounding the disposal port 41. Edges of the ventilation groove 133 is rounded. The ventilation groove 133 causes air to flow on a side nearer to the inner surface 132*a* of the bottom wall 132 of the container body 38 than the dust D. The concave portion 135 is located reverse face of the junction part 39 provided on an outer surface of the bottom wall 132 of the container body 38 and extends over a smaller area than the junction part 39.

The ventilation groove 133 causes air to flow toward the disposal port 41. The ventilation groove 133 is configured such that a depth dimension d in a thickness direction of the bottom wall 132, i.e., a groove depth dimension, is smaller than a width dimension w in a direction along the inner surface 132*a* of the bottom wall 132 of the container body 38, i.e., a groove width dimension. In other words, the ventilation groove 133 is a shallow groove. The depth dimension d of the ventilation groove 133 is substantially constant.

At least one ventilation groove 133 is provided in the inner surface of the bottom wall 132 of the container body 38. Plural ventilation grooves 133 may be provided. When plural ventilation grooves 133 are provided, preferably the plural ventilation grooves 133 are arranged at substantially equal intervals.

Note that the ventilation groove 133 may be made up of protrusions (not shown) arranged in a lattice pattern. The ventilation groove 133 may be a groove extending toward the disposal port 41 or a groove extending rectilinearly or curvilinearly by skirting the disposal port 41. The groove may extend rectilinearly, curvilinearly, or meanderingly by skirting the disposal port 41 as long as the groove causes airflow F produced in the container body 38 to circulate and produces a diversion f that blows up the dust gathering on the bottom wall 132 of the container body 38.

At the position where the autonomous robotic vacuum cleaner 2 is electrically connected to the charging electrodes 3 of the station 5, the disposal lid 42 is opened, and the disposal port 41 is connected to the dust transfer pipe 25 (FIG. 7). That is, the container body 38 is fluidly connected to the secondary electric blower 69 via the dust transfer pipe 25 and secondary dust container 68. When the secondary electric blower 69 is operated in this state, air flows into the container body 38 through the suction port 36 in the body casing 11. The airflow F entering the container body 38 causes relatively low-density dust Of the dust in the container body 38 such as lint and trash to flow out into the dust transfer pipe 25 through the disposal port 41.

Then, dust DH, such as clips left in a living room, higher in density than lint and trash may sometimes be accumulated along the inner surface 132*a* of the bottom wall 132 of the container body 38. The electric vacuum cleaning apparatus 1 according to the present embodiment causes the diversion f of the airflow F in the container body 38 to circulate in the ventilation groove 133 below the high-density dust DH. The diversion f flowing through the ventilation groove 133 causes almost all the dust in the container body 38 to flow out through the disposal port 41 to the dust transfer pipe 25.

In a flow distribution, flow velocity is lower near a wall surface than in places away from the wall surface. That is, an electric vacuum cleaning apparatus in which the inner surface of the bottom wall is simply a flat surface as with the conventional electric vacuum cleaning apparatus cannot produce the diversion f such as in the electric vacuum cleaning apparatus 1 according to the present embodiment. Thus, sufficient flow velocity is not available around the high-density dust DH accumulated along the inner surface of the bottom wall, and it is difficult to cause the high-density dust DH to flow out through the disposal port.

Thus, the electric vacuum cleaning apparatus 1 according to the present embodiment produces a flow (diversion f) of air around the high-density dust DH accumulated along the inner surface 132*a* of the bottom wall 132 of the container body 38 using the ventilation groove 133, and obtains a flow velocity sufficient to cause the dust DH to flow out through the disposal port 41.

Now, if the flow rate and flow velocity of airflow in the container body is increased using a high-power secondary electric blower, even the conventional electric vacuum cleaning apparatus can cause the high-density dust DH to flow out of the container body. However, even if the secondary electric blower 69 is relatively low-powered, the electric vacuum cleaning apparatus 1 according to the present embodiment to cause all the dust D including the high-density dust DH to flow out of the container body 38 with the ventilation groove 133.

Moreover, the ventilation groove 133 having a concavo-convex shape is configured to make it easy for the high-density dust DH to flow out to the disposal port 41 with reducing contact area between the high-density dust DH and the inner surface 132*a* of the container body 38. If the ventilation groove 133 can cause the high-density dust DH to float up from the inner surface 132*a* of the bottom wall 132 of the container body 38 once, the electric vacuum cleaning apparatus 1 can cause the high-density dust DH to flow out to the disposal port 41 by means of the airflow F in the container body 38 as well. Thus, the ventilation groove 133 may be a groove-shaped form extending toward the disposal port 41, and may be oriented in any direction as long as the diversion f of the airflow F can be produced or may be configured to produce airflow among protrusions arranged in a lattice pattern.

The electric vacuum cleaning apparatus 1 according to the present embodiment has at least one ventilation groove 133 adapted to cause air to flow below the dust D in the container body 38 under the negative pressure produced by the secondary electric blower 69 in the inner surface 132*a* of the bottom wall 132 of the primary dust container 12. This allows the electric vacuum cleaning apparatus 1 to smoothly dispose of the dust D from the container body 38.

The electric vacuum cleaning apparatus 1 according to the present embodiment is provided with the ventilation groove 133 adapted to cause air to flow toward the disposal port 41. Thus, the electric vacuum cleaning apparatus 1, can be lead the dust D that is blown up with the diversion f moving through the ventilation groove 133 smoothly to the disposal port 41 with the airflow F.

The electric vacuum cleaning apparatus 1 according to the present embodiment is provided with the round-cornered ventilation groove 133 having rounded edges. Consequently, the electric vacuum cleaning apparatus 1 can lead the dust D more smoothly to the disposal port 41 with avoiding the dust D being caught on the corners of the ventilation groove 133.

The electric vacuum cleaning apparatus 1 according to the present embodiment is provided with the ventilation groove 133 configured to be shallow, such that the depth dimension d in the thickness direction of the bottom wall 132 is smaller than the width dimension w in the direction along the inner surface 132*a* of the bottom wall 132 of the primary dust container 12. Consequently, the electric vacuum cleaning apparatus 1 can easily blow up the dust D with causing the diversion f of higher flow velocity to act more widely on bottom faces of the dust D while minimizing cross sectional area of the flow path of the ventilation groove 133.

The electric vacuum cleaning apparatus 1 according to the present embodiment is provided with the ventilation groove 133 having substantially constant depth dimension d in the thickness direction of the bottom wall 132 of the primary dust container 12. Consequently, even if dust D is gathered unevenly anywhere on the bottom of the primary dust container 12, the electric vacuum cleaning apparatus 1 can lead the dust D to the disposal port 41 with generating an appropriate diversion f.

The electric vacuum cleaning apparatus 1 according to the present embodiment includes plural ventilation grooves 133 provided in the inner surface 132*a* of the bottom wall 132 of the primary dust container 12. Consequently, even if dust D is gathered unevenly anywhere on the bottom of the primary dust container 12, the electric vacuum cleaning apparatus 1 can lead the dust D to the disposal port 41 by generating an appropriate diversion f.

The electric vacuum cleaning apparatus 1 according to the present embodiment is provided with plural ventilation grooves 133 arranged at substantially equal intervals. Consequently, even if dust D is gathered unevenly anywhere on the bottom of the primary dust container 12, the electric vacuum cleaning apparatus 1 can lead the dust D to the disposal port 41 by generating a substantially uniform diversion f in a wide area of the inner surface 132*a* of the bottom wall 132 of the primary dust container 12.

The electric vacuum cleaning apparatus 1 according to the present embodiment includes the inner surface 132*a* of the bottom wall 132 of the container body 38 that declines toward the disposal port 41. This makes it easy for the electric vacuum cleaning apparatus 1 to lead the dust D to the disposal port 41.

Therefore, the electric vacuum cleaning apparatus 1 according to the present embodiment allows the dust D to be disposed of easily from the primary dust container 12 of the autonomous robotic vacuum cleaner 2 to the station 5.

While certain embodiment has been described, this embodiment has been presented by way of example only, and is not intended to limit the scope of the inventions. Indeed, the novel embodiment described herein may be embodied in a variety of other forms; furthermore, various omissions, substitutions and changes in the form of the embodiment described herein may be made without departing from the spirit of the inventions. The accompanying claims and their equivalents are intended to cover such forms or modifications as would fall within the scope and spirit of the inventions.

REFERENCE SIGNS LIST

1 Electric vacuum cleaning apparatus
2 Autonomous robotic vacuum cleaner
3 Charging electrode
5 Station
11 Body casing
11*a* Bottom face
12 Primary dust container
13 Primary electric blower
15 Running gear
16 Driving force source
17 Robot controller
18 Rechargeable battery
21 Base part
22 Dust collector
23 Roller pair
25 Dust transfer pipe
25*a* Sealing member
26 Lever
29 Power cord
31 Rotating brush
32 Rotating brush driving force source
33 Spinning side brush
35 Spinning side brush driving force source
36 Suction port
37 Dust container opening
38 Container body
39 Junction part
41 Disposal port
42 Disposal lid
45 Driving wheel
46 Caster
47 Charging terminal
48 Brush base
49 Linear brush
61 High floor part
62 Low floor section
63 Cross direction roller
65 Stopping roller
66 Running surface
68 Secondary dust container
69 Secondary electric blower
71 Recess
72 Homing detector
73 First sensor assembly
75 Second sensor assembly
81 Main body
82 Lid
83 Erroneous suction preventing mechanism
85 Downstream pipe
86 Sealing surface
87 Claw
91 Pressure detecting section
92 Alarm section
93 Controller
95 Dust container chamber
96 Blower chamber
97 Hook
101 Suction port
102 Dust container
103 Discharge port
105 Lid
106 Net filter
107 Upstream passage
108 Downstream passage
109 Partition plate
110 Secondary filter
111 Cover pipe
112 Protruding section
113 Partition plate
115 First hinge mechanism
116 Second hinge mechanism
121 Ventilation hole
123 Lever catch
125 Shaft cover
126 Lid body
127 Coiled spring
131 Side wall
132 Bottom wall

132*a* Inner surface
133 Ventilation groove
135 Concave portion

The invention claimed is:

1. An electric vacuum cleaning apparatus, comprising:

an autonomous robotic vacuum cleaner adapted to autonomously move on a surface to be cleaned and collect dust from the surface; and a station fluidly connectable to the autonomous robotic vacuum cleaner;

wherein the autonomous robotic vacuum cleaner includes a container that accumulates the dust collected by the autonomous robotic vacuum cleaner and has a bottom wall that has a disposal port for disposing of the dust, and a disposal lid for opening and closing the disposal port, the station includes a dust transfer pipe coupled to the disposal port, a secondary dust container adapted to accumulate dust disposed of from the container body through a dust transfer pipe, and a secondary electric blower adapted to generate suction negative pressure in the dust transfer pipe via the secondary dust container, and at least one ventilation groove that causes air to flow below the dust accumulated in the container body under negative pressure generated by the secondary electric blower is provided on an inner surface of the bottom wall of the container body.

2. The electric vacuum cleaning apparatus according to claim 1, wherein the ventilation groove causes air to flow toward the disposal port.

3. The electric vacuum cleaning apparatus according to claim 1, wherein edges of the ventilation groove are rounded.

4. The electric vacuum cleaning apparatus according to claim 1, wherein a depth dimension of the ventilation groove in a thickness direction of the bottom wall is smaller than a width dimension of the ventilation groove in a direction along the inner surface of the bottom wall.

5. The electric vacuum cleaning apparatus according to claim 1, wherein a depth dimension of the ventilation groove in a thickness direction of the bottom wall is substantially constant.

6. The electric vacuum cleaning apparatus according to claim 1, wherein the at least one ventilation groove comprises a plurality of ventilation grooves, and the ventilation grooves are provided in the inner surface of the bottom wall.

7. The electric vacuum cleaning apparatus according to claim 6, wherein the ventilation grooves are arranged at substantially equal intervals.

8. The electric vacuum cleaning apparatus according to claim 1, wherein the inner surface of the bottom wall declines toward the disposal port.

9. The electric vacuum cleaning apparatus according to claim 2, wherein edges of the ventilation groove are rounded.

10. The electric vacuum cleaning apparatus according to claim 2, wherein a depth dimension of the ventilation groove in a thickness direction of the bottom wall is smaller than a width dimension of the ventilation groove in a direction along the inner surface of the bottom wall.

11. The electric vacuum cleaning apparatus according to claim 3, wherein a depth dimension of the ventilation groove in a thickness direction of the bottom wall is smaller than a width dimension of the ventilation groove in a direction along the inner surface of the bottom wall.

12. The electric vacuum cleaning apparatus according to claim 2, wherein a depth dimension of the ventilation groove in a thickness direction of the bottom wall is substantially constant.

13. The electric vacuum cleaning apparatus according to claim 3, wherein a depth dimension of the ventilation groove in a thickness direction of the bottom wall is substantially constant.

14. The electric vacuum cleaning apparatus according to claim 4, wherein a depth dimension of the ventilation groove in a thickness direction of the bottom wall is substantially constant.

15. The electric vacuum cleaning apparatus according to claim 2, wherein the at least one ventilation groove comprises a plurality of ventilation grooves, and the ventilation grooves are provided in the inner surface of the bottom wall.

16. The electric vacuum cleaning apparatus according to claim 3, wherein the at least one ventilation groove comprises a plurality of ventilation grooves, and the ventilation grooves are provided in the inner surface of the bottom wall.

17. The electric vacuum cleaning apparatus according to claim 4, wherein the at least one ventilation groove comprises a plurality of ventilation grooves, and the ventilation grooves are provided in the inner surface of the bottom wall.

18. The electric vacuum cleaning apparatus according to claim 5, wherein the at least one ventilation groove comprises a plurality of ventilation grooves, and the ventilation grooves are provided in the inner surface of the bottom wall.

19. The electric vacuum cleaning apparatus according to claim 2, wherein the inner surface of the bottom wall declines toward the disposal port.

20. The electric vacuum cleaning apparatus according to claim 3, wherein the inner surface of the bottom wall declines toward the disposal port.

* * * * *